US006234234B1

(12) United States Patent
Shiue

(10) Patent No.: US 6,234,234 B1
(45) Date of Patent: May 22, 2001

(54) VENETIAN BLIND

(76) Inventor: Ba-Shiuan Shiue, 430 Ping Ho Road Section 1, Tien Way Hsiang, Chan Hua Hsien (TW)

( * ) Notice: Subject to any disclaimer, the term of this patent is extended or adjusted under 35 U.S.C. 154(b) by 0 days.

(21) Appl. No.: 09/459,985

(22) Filed: Dec. 14, 1999

(51) Int. Cl.[7] ..... E06B 9/30

(52) U.S. Cl. ..... 160/168.1 R; 160/166.1; 160/374

(58) Field of Search ..... 160/166.1 R, 173 R, 160/178.1 R, 178.1 V, 236, 900, 374

(56) References Cited

U.S. PATENT DOCUMENTS 4,281,320 * 7/1981 Rosenberg ..... 160/166.1 X
5,440,289 * 8/1995 Riordan ..... 160/374 X
5,552,769 * 9/1996 Riordan ..... 160/374 X
5,825,289 * 10/1998 Riordan ..... 160/374 X
5,846,646 * 12/1998 Meppelink ..... 160/166.1 X

* cited by examiner

*Primary Examiner*—Daniel P. Stodola
*Assistant Examiner*—Bruce A. Lev
(74) *Attorney, Agent, or Firm*—Rabin & Champagne, P.C.

(57) ABSTRACT

A Venetian blind has a plurality of slats which can be set together at any angle or be drawn up together with a plurality of cords. The slats are made of a material conductive to electricity and are provided on two longitudinal side edges thereof with an insulation strip for preventing an electrical shock. The slats are connected at both longitudinal ends thereof with a power source. When the slats are drawn down, the slats are electrically charged so as to electrocute an intruding insect. When the slats are drawn up together, the power supply to the slats is interrupted.

2 Claims, 6 Drawing Sheets

FIG.1–A

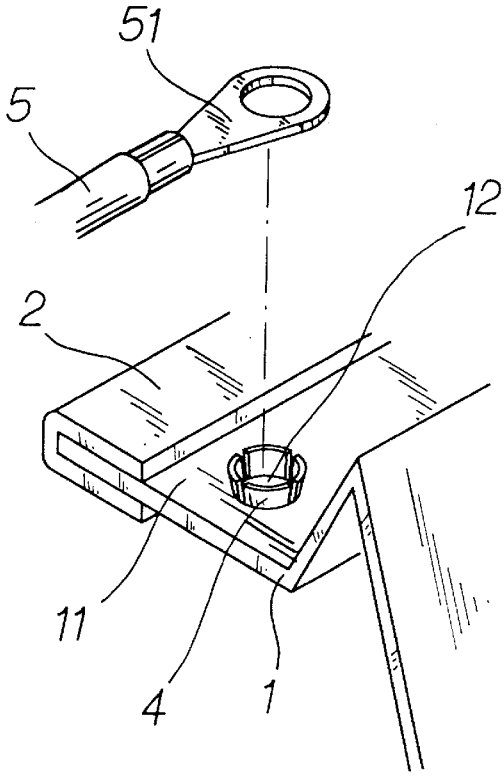
FIG. 1-B
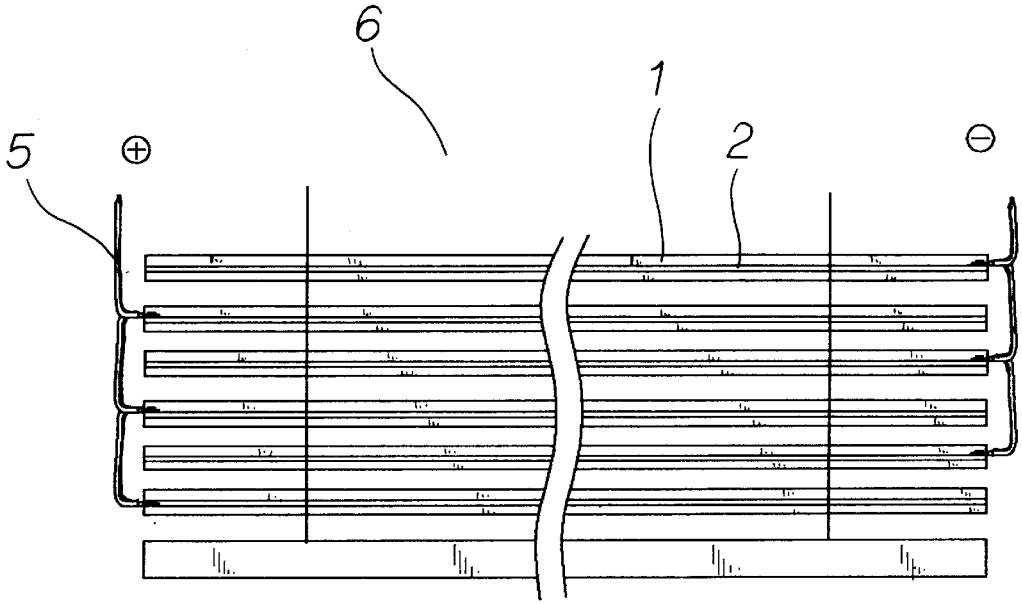
FIG. 2

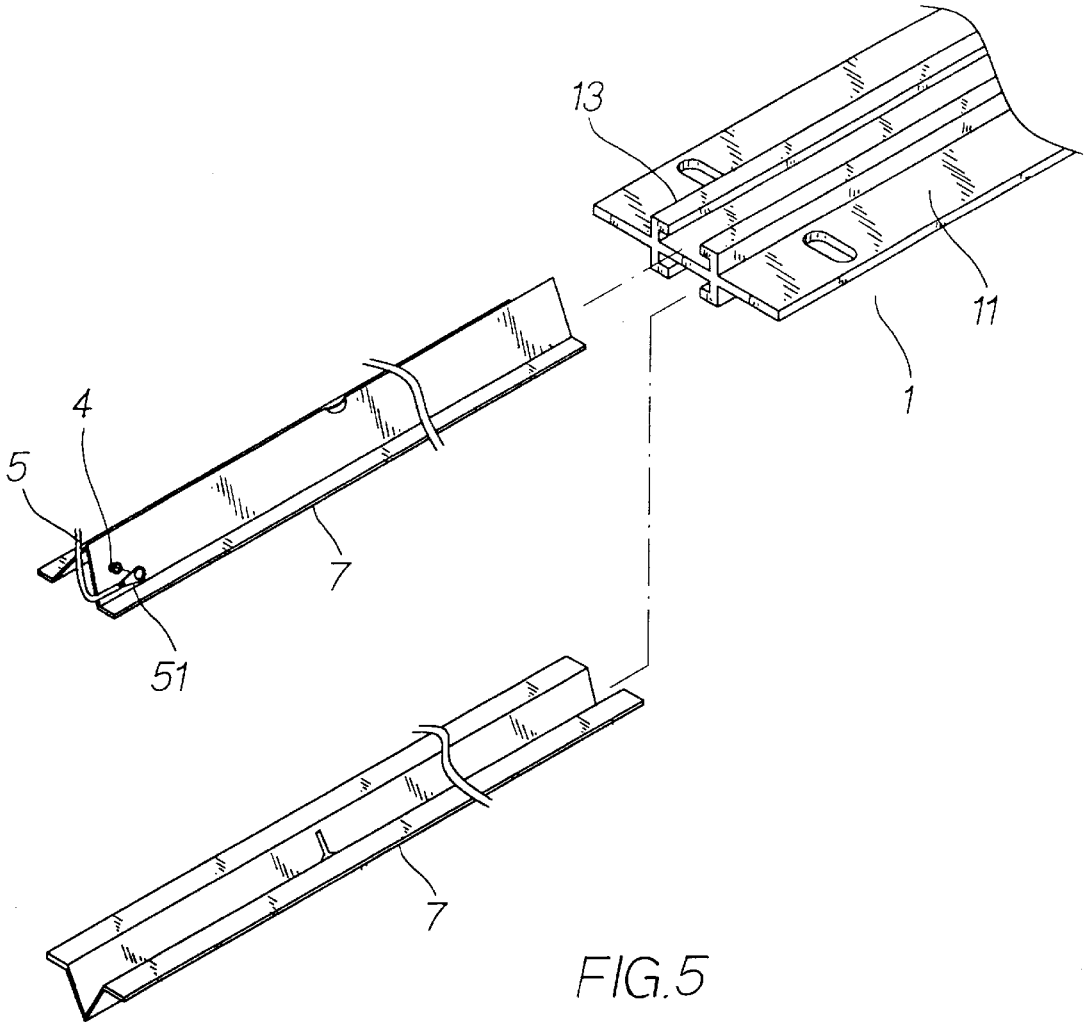
FIG.5
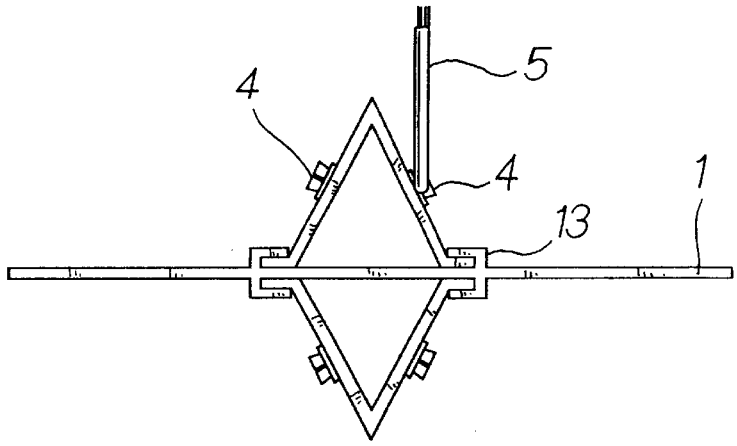
FIG.5-A

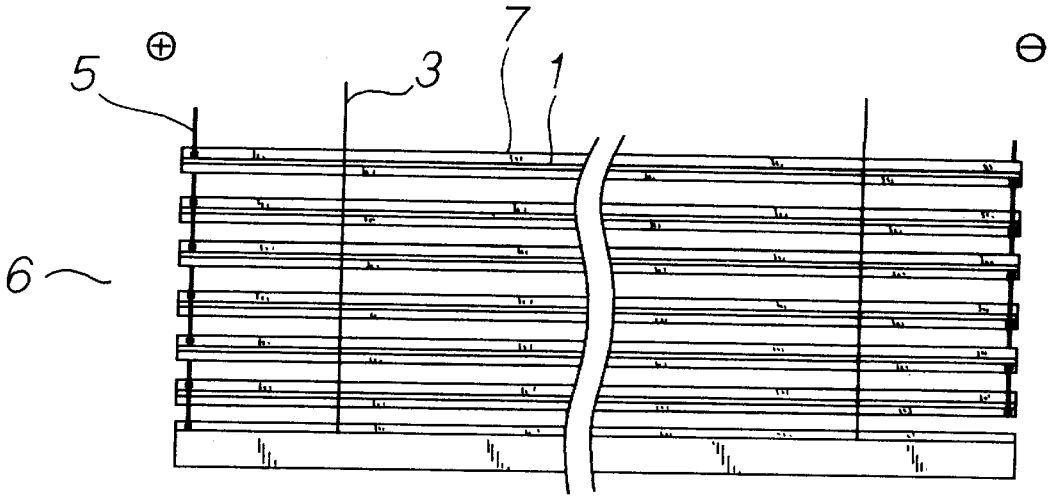
FIG.5-B
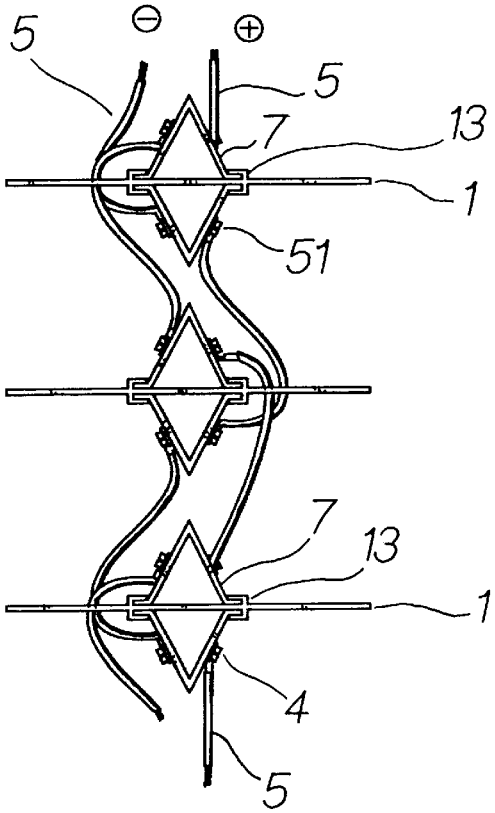
FIG.5-C

VENETIAN BLIND

FIELD OF THE INVENTION

The present invention relates generally to a Venetian blind, and more particularly to a Venetian blind which is provided with a means for repelling insects.

BACKGROUND OF THE INVENTION

The conventional Venetian blind is made of a number of thin, horizontal wooden, metal, or plastic slats that can be set together at any angle to regulate the light and the air passing through or be drawn up together to the top of the window by means of cords. Even though there are a variety of improved Venetian blinds available in the market place today, none of these are is provided with an insect-repelling means for preventing the insects from intruding into a room through the window of the room.

SUMMARY OF THE INVENTION

The primary objective of the present invention is to provide a Venetian blind capable of repelling insects.

In keeping with the principle of the present invention, the foregoing objective of the present invention is attained by a Venetian blind comprising a plurality of slats which can be set together at any angle to regulate the light and the air passing through or be drawn up together to the top of the window by means of a plurality of cords. The slats are provided along the longitudinal side edges thereof with an insulation strip for preventing the electrical shock. The slats are connected with a power source by a conductive wire. When the slats are drawn down, the power switch is turned on to make power available to the slats via the conductive wires. Any intruding insect is electrocuted when it comes in contact with the electrically-charged slats. When the slats are drawn up together, the power switch is turned off so as to interrupt the power supply to the slats.

The foregoing objective, features, and functions of the present invention will be more readily understood upon a thoughtful deliberation of the following detailed description of the present invention with reference to the accompanying drawings.

BRIEF DESCRIPTION OF THE DRAWINGS

FIG. 2 shows a partial schematic view of the present invention in combination.

FIG. 5 shows a partial exploded view of a second preferred embodiment of the present invention.

FIGS. 5A, 5B and 5C are schematic views of the second preferred embodiment of the present invention in combination.

DETAILED DESCRIPTION OF THE INVENTION

Figure 1:
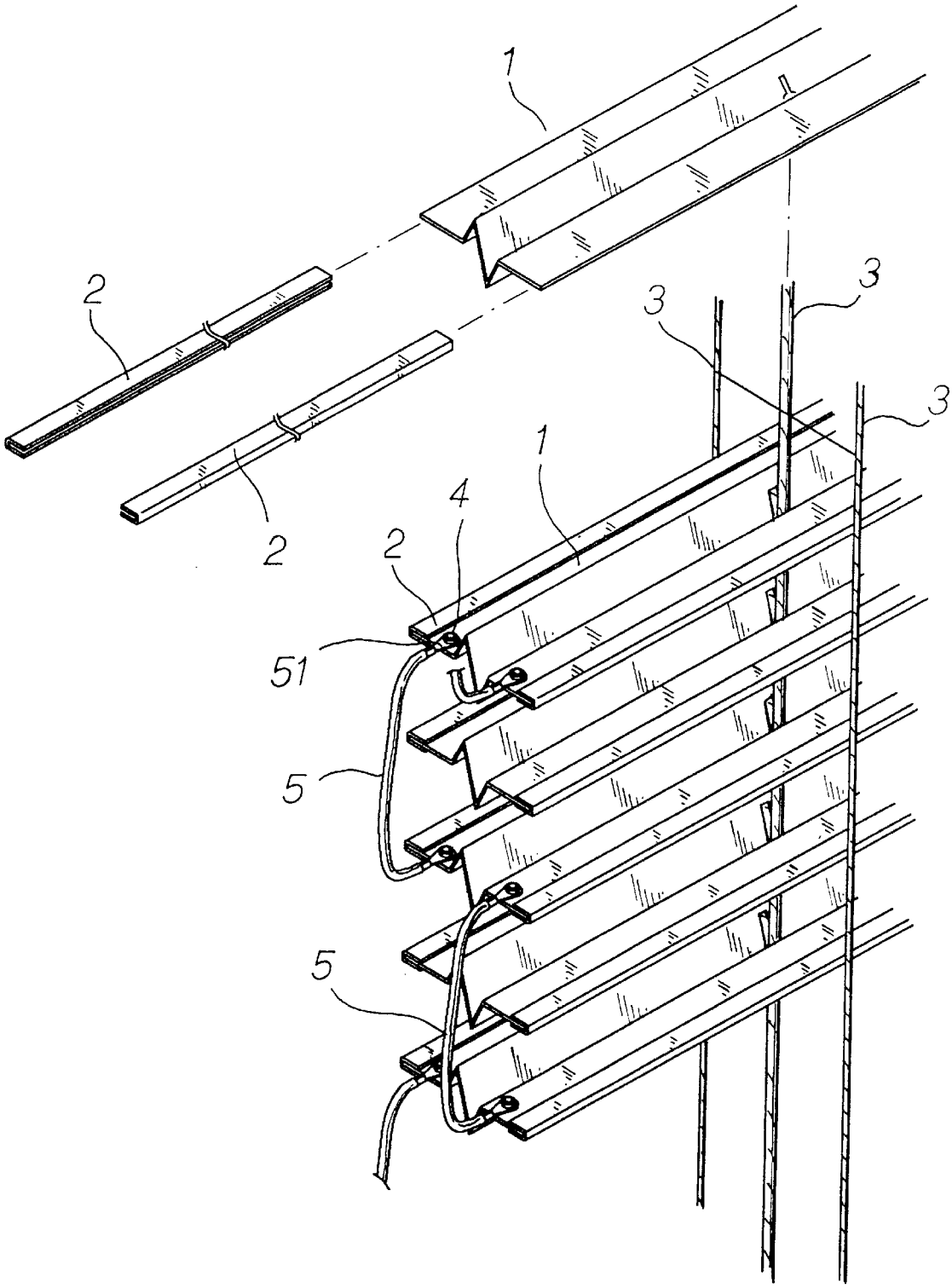
FIG. 1A shows a partial exploded view of the present invention.
FIG. 1B shows another partial exploded view of the present invention.
Figure 3:
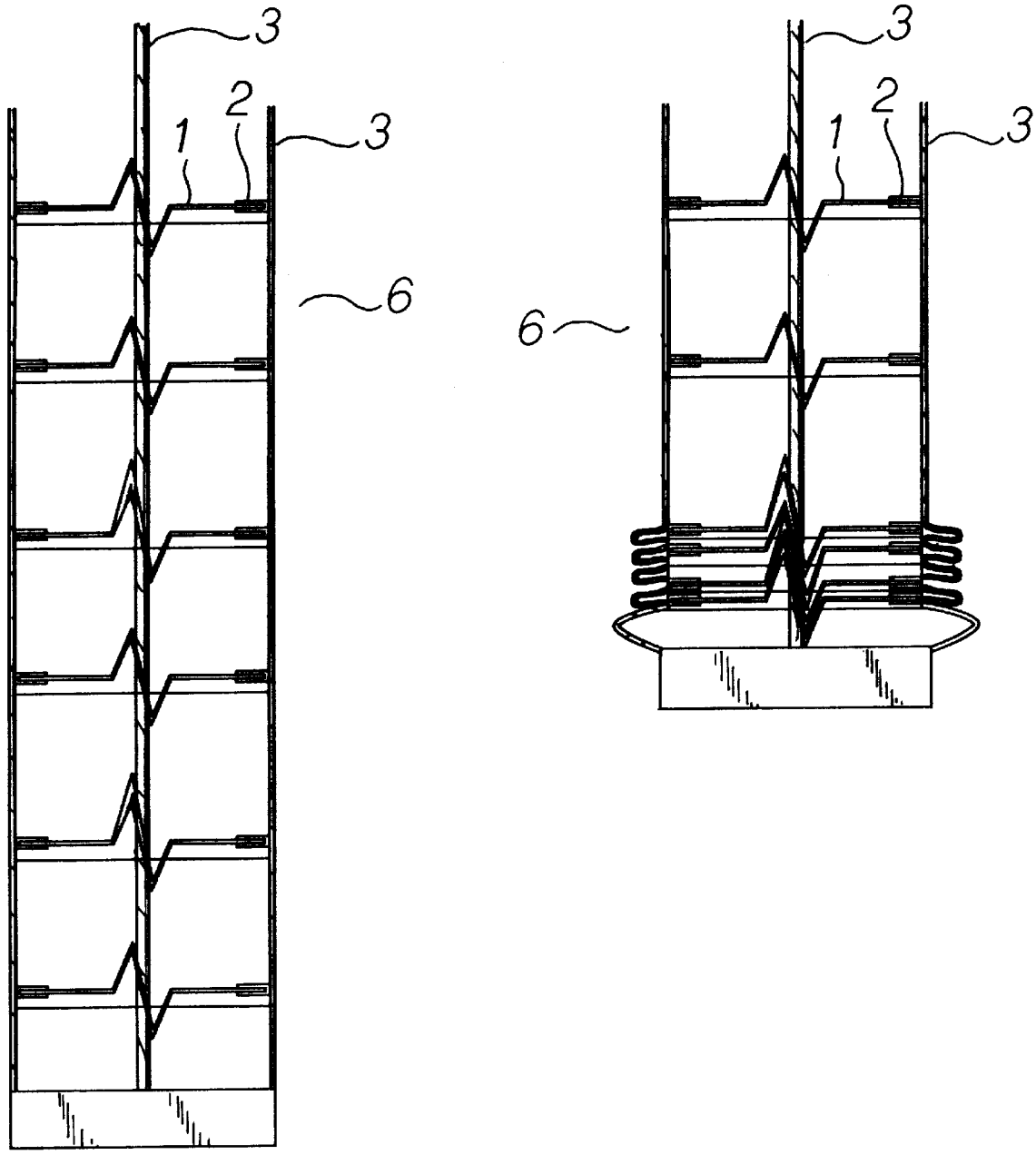
FIG. 3 shows a schematic view of the slats of the present invention being drawn up.
Figure 4:
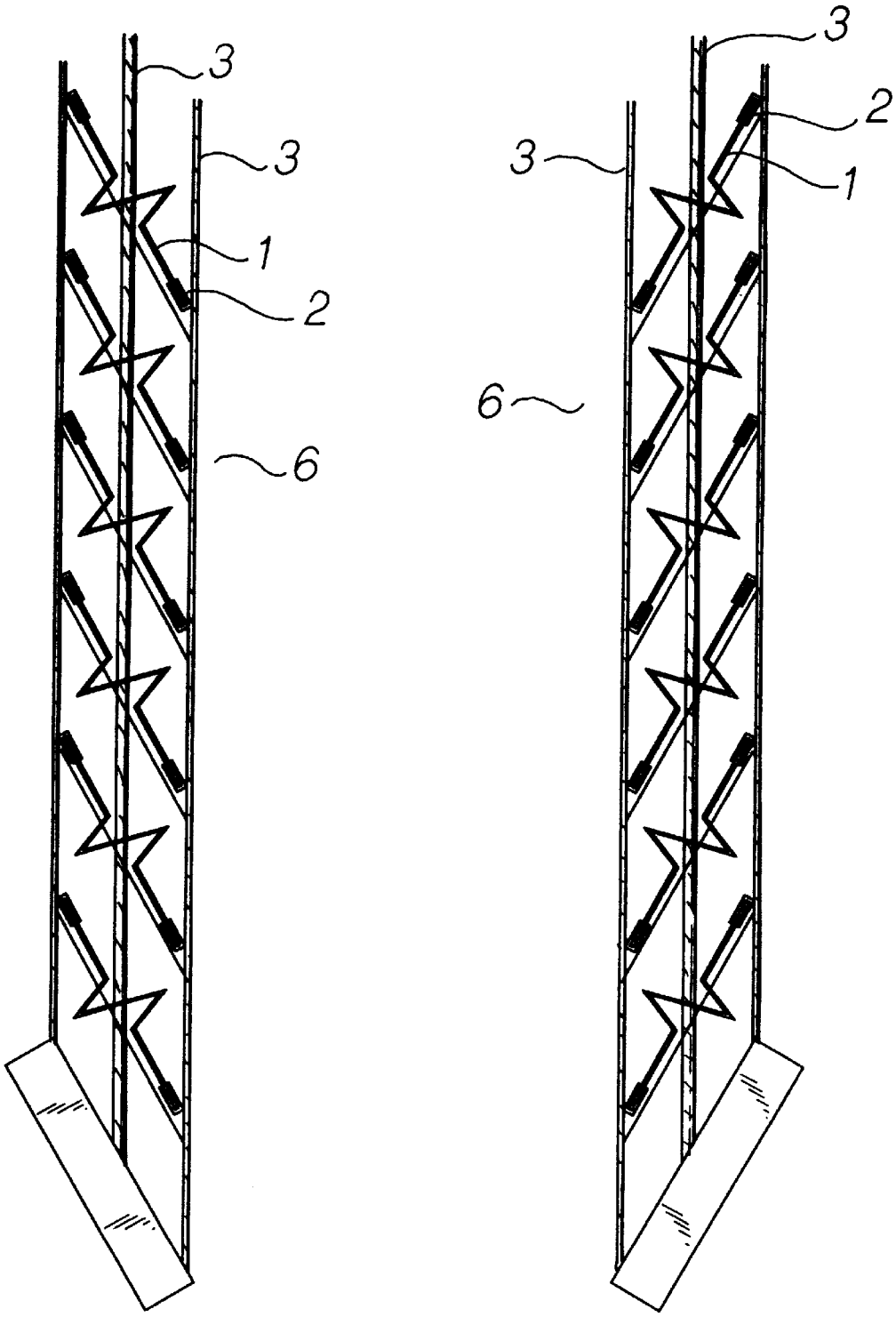
FIG. 4 shows a schematic view of the slats of the present invention being adjusted angularly.

As shown in FIGS. 1–4, a Venetian blind 6 embodied in the present invention has a plurality of wavy slats 1, which are made of a metal material and can be set together at any angle or be drawn up together by means of a plurality of cords 3 that are put through the through holes 12 of the slat surfaces 11 of the slats 1. The slats 1 are provided at two longitudinal side edges thereof with an insulation strip 2 for preventing an electrical shock. The slats 1 are connected at both longitudinal ends thereof with a power source (not shown in the drawings) by means of a conductive wire 5 in conjunction with a connector 51 and a nut 4.

When the slats 1 of the Venetian blind 6 of the present invention are drawn down, the power switch (not shown in the drawings) is turned on so as to make power available to the slats 1 via the conductive wires 5. Any intruding insect is electrocuted when it comes in contact with the electrically-charged slats 1. When the slats 1 are drawn up together, the power switch is turned off to interrupt the power supply to the slats 1 of the Venetian blind 6 of the present invention.

As shown in FIGS. 5, 5A, 5B, and 5C, the slats 1 are made of a material nonconductive to electricity and are provided in the upper surface 11 thereof and the underside 11 thereof with a guide rail 13 and a conductive block 7 which is fitted into the guide rail 13 and is connected with the power source (not shown in the drawings) by means of the conductive wire 5 in conjunction with the connector 51 and the nut 4. The conductive blocks 7 are projected from the surfaces 11 of the slats 1. Any intruding insect is electrocuted by the electrically-charged conductive blocks 7.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A Venetian blind, comprising:

a plurality of slats which can be set together at any angle or be drawn up together by a plurality of cords, said slats being made of a material conductive to electricity and being provided on two longitudinal side edges thereof with an insulation strip fastened thereto for preventing an electrical shock, said slats being connected at respective longitudinal ends thereof with a conductor and a nut whereby said slats are electrically charged to electrocute an intruding insect at a time when said slats are drawn down.

2. A Venetian blind, comprising:

a plurality of slats which can be set together at any angle or be drawn up together using a plurality of cords, said slats being made of a material nonconductive to electricity, said slats being provided at an upper surface thereof and at an underside thereof with a guide rail extending from one end of a longitudinal axis of said slats to another end of the longitudinal axis of said slats, each said guide rail being provided with a conductive block fitted there into such that said conductive blocks respectively project from the upper surface and the underside of said slats, each said conductive block being connected with a power source by a conductive wire in conjunction with a connector and a nut, each said conductive block being electrically charged to electrocute an intruding insect at a time when said slats are drawn down.

* * * * *